US011320247B2

(12) United States Patent
Thornhill

(10) Patent No.: US 11,320,247 B2
(45) Date of Patent: May 3, 2022

(54) STAND-OFF BREACHING ROUND

(71) Applicant: THE SECRETARY OF STATE FOR DEFENCE, Salisbury (GB)

(72) Inventor: Lee Jonathan Thornhill, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 0 days.

(21) Appl. No.: 16/643,742

(22) PCT Filed: Sep. 1, 2018

(86) PCT No.: PCT/GB2018/000118
§ 371 (c)(1),
(2) Date: Mar. 2, 2020

(87) PCT Pub. No.: WO2019/053393
PCT Pub. Date: Mar. 21, 2019

(65) Prior Publication Data

US 2021/0156655 A1 May 27, 2021

(30) Foreign Application Priority Data

Sep. 12, 2017 (GB) ..... 1714624

(51) Int. Cl.
*F42B 12/20* (2006.01)
*F42B 1/02* (2006.01)
(Continued)

(52) U.S. Cl.
CPC ..... *F42B 12/204* (2013.01); *F42B 1/02* (2013.01); *F42B 12/105* (2013.01); *F42C 13/06* (2013.01)

(58) Field of Classification Search
CPC ..... F42B 12/204; F42B 12/105; F42B 1/02; F42C 13/06
(Continued)

(56) References Cited

U.S. PATENT DOCUMENTS 5,111,746 A * 5/1992 Pentel ..... F42B 12/16 102/308
5,373,790 A * 12/1994 Chemiere ..... F42B 12/58 102/226
(Continued)

FOREIGN PATENT DOCUMENTS

WO 2016098096 A1 6/2016
WO WO-2016098096 A1 * 6/2016 ..... F42B 12/207

OTHER PUBLICATIONS

International Patent Application No. PCT/GB2018/000118, International Preliminary Report on Patentability dated Mar. 26, 2020, 10 pages.
(Continued)

*Primary Examiner* — John Cooper
(74) *Attorney, Agent, or Firm* — Kilpatrick Townsend & Stockton LLP

(57) ABSTRACT

A stand-off breaching device (20) for breaching a barrier, comprising a housing (21), an explosive main charge (24) having a barrier-end (25) and a rear-end (26), a detonator (29), and means for initiating the detonator (27) when the explosive main charge (24) is at a preselected distance from a barrier. The detonator (29) is configured to detonate explosive main charge (24) at the rear-end (26) such that the resultant detonation wave propagates through the explosive main charge (24) towards the barrier-end (25) and the barrier being breached. This configuration provides more efficient transfer of explosively generated overpressure towards a barrier, thereby enabling the use of explosive main charges (24) with reduced mass, and the associated improvements in
(Continued)

operator safety. The breaching device (20) is particularly suited to use in door breaching operations.

31 Claims, 8 Drawing Sheets

(51) Int. Cl.
*F42B 12/10* (2006.01)
*F42C 13/06* (2006.01)

(58) Field of Classification Search
USPC ..... 102/476
See application file for complete search history.

(56) References Cited

U.S. PATENT DOCUMENTS 7,284,490 B1 * 10/2007 Mutascio ..... F42B 12/30 102/474
8,297,190 B1 * 10/2012 Dindl ..... F42B 12/204 102/439
9,389,053 B2 * 7/2016 Willhelm ..... F42C 1/02
2003/0177933 A1 * 9/2003 Fortner ..... F42B 12/16 102/476
2011/0174187 A1 * 7/2011 Van Stratum ..... F42B 30/04 102/464
2012/0216698 A1 * 8/2012 Van Stratum ..... F42C 1/14 102/439
2017/0191814 A1 * 7/2017 Grace ..... F42C 19/0842

OTHER PUBLICATIONS

United Kingdom Patent Application No. GB1814267.9, Examination Report dated Feb. 14, 2020, 2 pages.
International Patent Application No. PCT/GB2018/000118, International Search Report and Written Opinion dated Nov. 16, 2018, 14 pages.

* cited by examiner

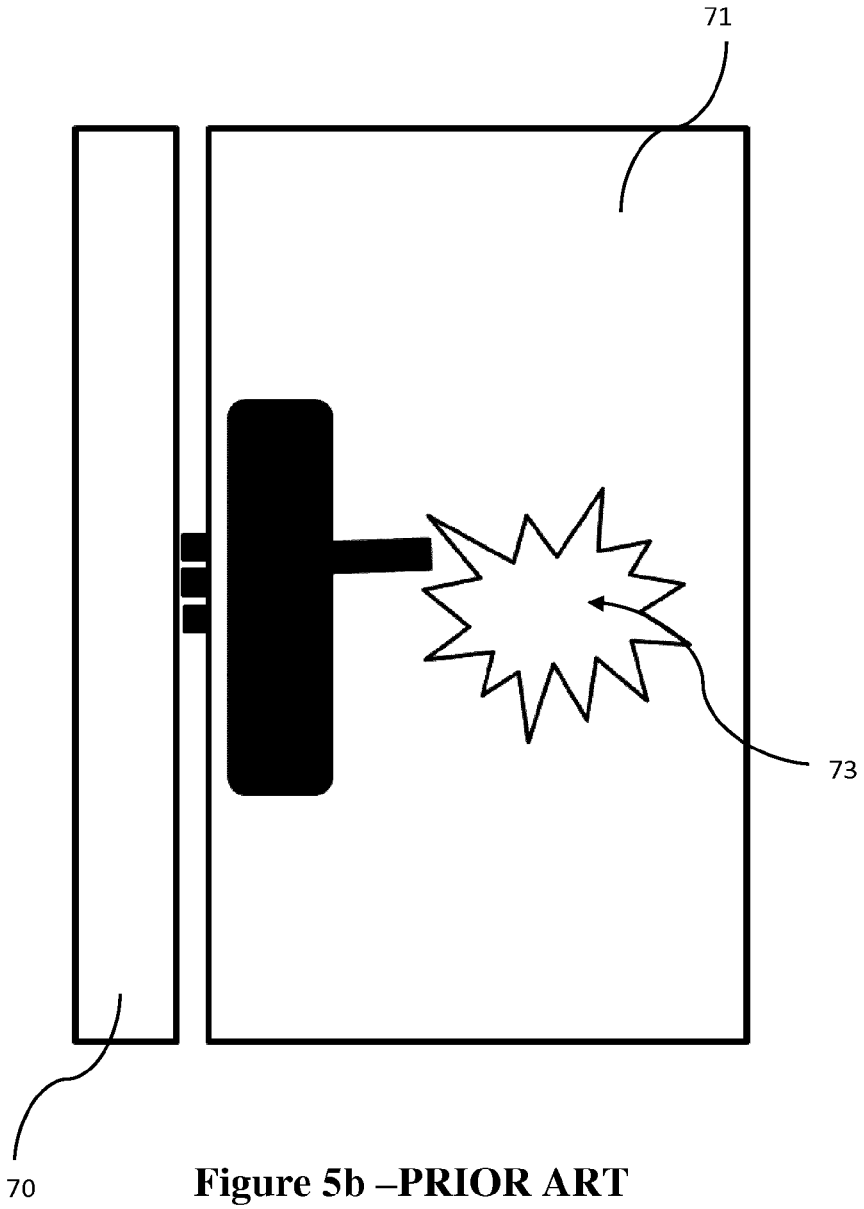
Figure 5b –PRIOR ART

STAND-OFF BREACHING ROUND

TECHNICAL FIELD OF THE INVENTION

This invention relates to the field of barrier breaching, in particular to devices suitable for stand-off barrier breaching.

BACKGROUND TO THE INVENTION

Breaching is a method of forcible entry through a barrier into an enclosure that is otherwise difficult or impossible to enter via other means. Door breaching specifically refers to forcing open an inward opening door (i.e. opening into an enclosure which may be a room) or outward opening door (i.e. opening towards the individual trying to gain entry) that is locked, wedged shut, or fixed shut through some means. Breaching as a technique extends to analogous situations with windows and even to through-wall penetration. Furthermore breaching is not limited to fixed buildings, but is a technique equally applicable to gain entry to vehicles and other enclosed spaces.

Breaching devices comprise tools or equipment used to apply force to a door, window or other barrier in order to gain entry. Such devices are necessary in many situations where force exerted by an individual (pushing or kicking for instance) is insufficient. Mechanical devices used for breaching include lever items such as crowbars and the battering rams that are often used by police, military or other emergency services. These devices, whilst useful in a number of scenarios, are often cumbersome, relatively slow to use, and require the user to be in immediate proximity to the entry point itself.

A different option for breaching is ballistic breaching. In ballistic breaching a projectile is fired at a barrier (such as a door), or part thereof (often the locking mechanism or hinges), in order to damage or deform the barrier enough to gain entry. Devices applicable to ballistic breaching include small arms weapons systems such as hand-held guns and rifles. However these devices are ineffective for certain barriers (such as steel doors), and where they are applicable, still require relatively close if not immediate proximity to the barrier (less than 100 mm range is often required). Furthermore these devices often provide a relatively slow means of entry (multiple firings of the gun or rifle is normally required).

The fastest option for breaching in many cases is explosive breaching. Devices used for explosive breaching comprise explosive material that can be detonated in close proximity to, or on, the barrier. A simple explosive breaching device may comprise explosive material physically attached to the entry point, and then detonated remotely by a user. However, such an approach requires direct access to the barrier, which is not desirable where the contents of the enclosure being entered are unknown or potentially dangerous to the individual seeking access (for instance booby trapped entry points to rooms), or where the individual simply cannot gain direct access to the barrier at all.

The problem of breaching a barrier quickly, without direct access, is improved by the use of a stand-off breaching device. A stand-off breaching device comprises explosive material in a format that can be fired at, or held in close proximity to, a barrier, but detonated remotely. Stand-off breaching devices can be fired from a gun or rifle towards a barrier. The majority of stand-off breaching rounds comprise a housing of a format suited to the gun or rifle from which it is being fired. Therefore the housing is often cylindrical and has a diameter suited to the gun calibre. The housing typically contains a detonator, mechanical impact fuze and a cylindrical explosive main charge conformal to the housing. When used, the breaching round is fired and impacts a barrier, the rapid deceleration resulting in the mechanical impact fuze triggering point detonation of the explosive main charge. The detonation of the explosive main charge generates an axial overpressure that acts upon the barrier in an attempt to force the barrier open. Owing to the position of the point of detonation (at the end of the cylindrical charge closest to the barrier), the detonation wave propagates through the explosive main charge in a direction away from the barrier, resulting in a significant portion of the force from the explosion not being usefully applied. Furthermore, cylindrical explosive main charges generate radial overpressures that propagate parallel to the geometrical plane containing the circular cross section of the cylindrical charge i.e. perpendicular to the required direction. This radial overpressure often exceeds the axial overpressure. As a result, the majority of stand-off breaching rounds are inefficient and require relatively high mass explosive main charges to deliver the desired breaching effect in the axial direction. The requirement to impact the barrier in order to detonate the breaching round, combined with the relatively high mass explosive, can also result in damage to and fragmentation of the barrier, both towards the user of the breaching round, and into the enclosure on the opposite side of the barrier to the user. Such effects increase the risk of harm to the user of the stand-off breaching round, thereby forcing the user further away from the barrier, for instance towards a stand-off of 15 m or more. Such a large stand-off is undesirable in applications where rapid entry after breaching a barrier is required.

Therefore it is an aim of the invention to provide a breaching device suitable for use in stand-off applications that mitigates these issues.

SUMMARY OF THE INVENTION

According to a first aspect of the invention there is provided a stand-off breaching device for breaching a barrier, comprising a housing, an explosive main charge having a barrier-end and a rear-end, a detonator, and means for initiating the detonator when the explosive main charge is at a preselected distance from a barrier, wherein the detonator is configured to detonate the explosive main charge at the rear-end, such that in-use a barrier can be breached by an explosively generated overpressure.

The term 'housing' is used to mean a casing that at least partially encloses some or all of the components of the stand-off breaching device. It is typical for most stand-off breaching rounds to have a housing or casing containing the components of the breaching round. This is essential considering that the components of the breaching round are intended to be projected, together, towards the barrier being breached. In the majority of cases, the components of the stand-off breaching device will be entirely enclosed by the housing. However, particular embodiments can be envisaged where this will not be the case (for instance it may be necessary to have openings in the housing suitable for particular types of fuzing mechanism). The housing is in most circumstances determined by the format of a gun, rifle, or other apparatus firing or launching the breaching device, and therefore various dimensions or shapes for the housing can be envisaged. The housing may comprise a bulbous or dome shaped nose, optionally formed from rubber.

The explosive main charge is the charge that upon detonation, results in the force providing the breaching effect (the explosively generated overpressure). The explosive main charge has a barrier-end and a rear-end and is intended to be a substantially non-hollow charge (not a shaped charge) The barrier-end of the explosive main charge is orientated towards the barrier to be breached when the stand-off breaching device is in use (it is in facing relations with the barrier). The rear-end is orientated away from the barrier to be breached when the stand-off breaching device is in use. The detonator of the breaching device is configured to detonate the explosive main charge at the rear-end. This results in the detonation wave (and resultant explosive shock wave) propagating from the rear-end towards the barrier-end, thereby delivering a force (owing to the resultant over-pressure) in the direction of the barrier being breached. A barrier can then therefore be breached by action of the explosively generated overpressure, and not through use of explosively formed projectiles or the impact of the breaching round itself.

The term 'detonator' is used to indicate a device that initiates the detonation of the main explosive charge. The detonator may be a chemical, mechanical or electrical detonator. For instance, the detonator may comprise a small amount of highly explosive material connected to electrically conductive material such as electrical wiring. The highly explosive material may be connected to further explosive material in an explosive train, the explosive train finally interfacing with the explosive main charge. The small amount of high explosive may then itself be detonated by passing a current through the electrical wiring, triggering the detonation of the explosive train of material and ultimately detonation of the explosive main charge. Alternatively the detonator may comprise electrical wiring attached directly to the rear-end of the explosive main charge (for instance an explosive bridge wire), such that when electrical current is passed through the electrical wiring, the explosive main charge is detonated. In preferred embodiments the detonator comprises a firing pin, a firing pin actuator and a stab detonator. The firing pin may be of a standard design as used with stab detonators. The firing pin actuator may be a piston actuator comprising a small propellant charge initiated by a bridge wire. Upon initiation, the piston in the actuator may drive the firing pin into the stab detonator, which subsequently initiates the explosive main charge. In these preferred embodiments, no direct electrical connection is made to the explosive main charge, instead the kinetic energy of the firing pin striking the stab detonator (itself often comprising highly explosive material) provides the detonation.

The means for initiating the detonator when the explosive main charge is at a preselected distance from a barrier may be an elongate extension upon the barrier facing end of the housing. The elongate extension would impact a barrier being breached and cause a deceleration of the stand-off breaching device. The deceleration may be used to drive a firing pin into a stab detonator. In these embodiments the length of the elongate extension can be configured to deliver the required preselected distance (for instance it may be possible to adjust the length in manufacture of the housing, or extend the extension immediately prior to use of the breaching device to suit a particular barrier, if a removable modular extension is provided). Alternatively the detonator may require a signal to detonate the main charge, such as may be provided by a proximity sensor on-board the breaching device.

In preferred embodiments of the invention the explosive main charge is a conically formed explosive main charge having a substantially circular end and a cone-apex, the conically formed explosive main charge being arranged such that the substantially circular end is the barrier-end and the cone-apex is the rear-end, such that when the stand-off breaching device is in use, the conically formed explosive main charge is detonated at the cone-apex. The diameter of the conically formed explosive main charge parallel to the substantially circular end decreases from the substantially circular end through to the cone-apex. The decreasing diameter may be a linear decrease or may be non-linear. The conically formed explosive main charge is not a hollow charge (not a shaped charge) but is a solid explosive main charge. The use of the term 'substantially' indicates that the circular end may not be perfectly circular (for instance if having to conform to a feature of the housing). The term 'cone-apex' is used to describe the peak of the cone in accordance with the common geometrical understanding of a cone shape. However, in some embodiments, the conically formed explosive main charge may take the form of a truncated cone. In these embodiments a portion of the cone comprising the peak of the cone is cut away, such that the cone-apex becomes a truncated cone-apex (i.e. the truncated cone-apex refers to the end of the cone opposite to the substantially circular end). In accordance with embodiments of the invention featuring the conically formed explosive main charge, the rear-end of the explosive main charge is the cone-apex (or truncated cone-apex), such that when the stand-off breaching device is used, it is detonated at the cone-apex (or truncated cone-apex). This arrangement not only results in the detonation shockwave propagating from the rear-end towards the barrier being breached, but also minimises wasted energy owing to forces propagating in the geometrical plane parallel to the substantially circular end. Therefore not only is this arrangement more efficient, it is also safer for the operator as the overpressure generated in off-barrier directions is reduced. This provides a significant improvement over commonly used cylindrical shaped explosive main charges. In particular embodiments the apex-angle (the angle subtended by the cone-apex, or in the case of a truncated cone-apex, the angle subtended by the cone-apex before truncation) of the conically formed explosive main charge is preferably in the range of 50 to 70 degrees, or even more preferred is 60 degrees.

In certain embodiments, the conically formed explosive main charge further comprises a charge extension formed at the substantially circular end. The charge extension preferably defines an inverted truncated cone having a maximum diameter substantially equal to the diameter of the substantially circular end that decreases as the inverted truncated cone extends away from the substantially circular end. Introducing a charge extension changes the pressure profile of the explosively generated overpressure, thereby changing the influence of the overpressure on the barrier. Adapting the charge extension allows the influence of the overpressure to be tailored, for instance by reducing the on-axis peak overpressure (relative to the axis of the main charge) and spreading the overall shock effect across a larger area of the barrier.

In other embodiments of the invention the explosive main charge is a multi-point initiated explosive main charge. Initiating the main charge at multiple positions substantially simultaneously results in multiple detonation waves propagating through the charge towards the barrier. These detonation waves will interfere with each other to achieve an increased force upon the barrier at certain angles relative to the main charge axis.

In some embodiments of the invention, the means for initiating the detonator comprises a proximity sensor, the proximity sensor being configured to detect radiation of a predetermined wavelength. The radiation of predetermined wavelength may have been emitted by a radiation source remote from the stand-off breaching device. For instance, the gun or rifle firing the breaching device may comprise a radiation source that illuminates the barrier up until the breaching device detonates. However, in preferred embodiments the proximity sensor is further configured to transmit radiation of the predetermined wavelength. The proximity sensor is apparatus through which proximity to a barrier is determined, when the stand-off breaching device is in use, thereby allowing the explosive main charge to be detonated at an optimum time and preselected distance relative to the barrier. The proximity sensor may be entirely contained within the housing of the stand-off breaching device, or may comprise features not entirely contained by the housing. For instance, a proximity sensor may require the housing to have cut-outs or windows to allow line of sight from the proximity sensor to the barrier in order to measure distance. In most embodiments comprising a proximity sensor, it is expected that the sensor will be arranged at the end of the housing orientated towards the barrier to be breached, when the stand-off breaching device is in use. There exist various types of proximity sensors that may be used in the stand-off breaching device. These include sensors capable of detecting electromagnetic radiation (for example radio waves, optical radiation, infrared radiation), or sensors capable of detecting acoustic radiation such as piezoelectric devices, microphones and ultrasonic devices. To generate the radiation of predetermined wavelength an on-board radiation source may be used such as antennas, diodes, lasers or piezoelectric devices, acoustic speakers, or ultrasound transceivers. The on-board radiation source may omit continuous radiation or modulated or pulsed radiation. In embodiments comprising a proximity sensor, the housing may comprise transmissive portions, the transmissive portions allowing the radiation of predetermined wavelength to propagate through the housing. Alternatively there may be apertures through the housing, thereby allowing radiation to propagate into, or out of, the stand-off breaching device. Some alternative embodiments may comprise an impact fuze and therefore require contact with a barrier in order to detonate. This may be achieved whilst still providing the explosive main charge at a preselected distance from the barrier, by extending the housing forwards (in the barrier direction) of the explosive main charge.

In some embodiments the proximity sensor further comprises an electronics module, the electronics module being configured to measure a signal-difference between the transmitted radiation of pre-determined wavelength and the detected radiation of predetermined wavelength, the signal-difference corresponding to range-to-go. The term 'range-to-go' refers to the line of sight distance from the proximity sensor to the barrier (or other source reflecting the radiation of predetermined wavelength). The signal-difference may be a time delay. For instance the on-board radiation source may emit pulsed radiation, with the time delay between emitting a pulse and the proximity sensor receiving a pulse (reflected from the barrier for instance), indicating the range to the barrier. Alternatively the power of the radiation emitted by the on-board radiation source may be compared to that received by the proximity sensor, and a range-to-go indication generated therefrom.

In particular embodiments the electronics module is configured to output a first detonation signal when the range-to-go is less than or equal to the preselected distance. The first detonation signal may then be received by the detonator. The first detonation signal may be an electrical pulse or constant electrical voltage and current. The preselected distance may be between 50 mm and 250 mm. It is envisaged that in some embodiments of the invention the preselected distance will be programmable according to the barrier being breached. For instance a heavily locked or barricaded barrier may require a lower preselected distance than a door that is not barricaded shut. In such embodiments the preselected distance may be stored in an on-board memory device.

In further embodiments of the stand-off breaching device the means for initiating the detonator comprises a safe-to-arm unit, the safe-to-arm unit being configured to allow detonation of the explosive main charge upon at least a first post-launch criterion being satisfied, and the generation of the first detonation signal. In embodiments of the invention comprising a firing pin, firing pin actuator and stab detonator, the stab detonator may be deliberately misaligned with the firing pin, such that the firing pin will not impact the stab detonator without further modification. The safe-to-arm unit may be a mechanism whereby the stab detonator is rotated into alignment with the firing pin after launch of the stand-off breaching device. For instance, the breaching device may rotate upon launch owing to a rifling effect. This rotation may exert a force upon the stab detonator that can be utilised to rotate the stab detonator into alignment with the firing pin, for instance, after a number of rotations have elapsed. Therefore the first post-launch criterion may be a quantity of rotations. Alternatively the first post-launch criterion may be an acceleration threshold, such as that detected by a gravity switch. Upon launch the stand-off breaching device will experience an acceleration that could be detected by a gravity switch. A time delay may be additionally implemented such that a short time thereafter the first post-launch criterion is satisfied, the detonation of the explosive main charge is allowed. A gravity switch may also be used to detect a rapid deceleration upon impact. For instance if a rapid deceleration is detected, and a certain time from launch has not elapsed prior to the deceleration, the safe-to-arm unit may prevent detonation altogether, thereby preventing detonation at an unsafe distance from a user.

The radiation of predetermined wavelength may be acoustic radiation with a wavelength, or a range of wavelengths, in the range 20 kHz to 100 kHz. Alternatively the radiation of predetermined wavelength may be electromagnetic radiation with a wavelength, or a range of wavelengths, in the range 800 nm to 1200 nm.

Embodiments of the invention further comprise an eject cartridge attached to the housing. The stand-off breaching device may be projected or fired towards a barrier using suitable apparatus such as a gun or rifle or other weapons launcher. To propel the breaching device towards the barrier it must be ejected from said apparatus. An eject cartridge may therefore comprise explosive material or pressurised gas, that upon activation (or 'release' in the case of gas) results in a force propelling the breaching device in a user selected direction (i.e. the direction in which the breaching device is aimed). An example of an eject cartridge is the DM 1382 cartridge case currently used for other 40 mm rounds. The eject cartridge is non-permanently attached to the housing. In most embodiments the eject cartridge remains inside a launcher from which breaching device is launched. Therefore, the term 'attached' is intended to include embodiments wherein, upon activation of the eject cartridge, the attachment to the breaching device is overcome or broken, thereby allowing the breaching device to separate from the eject cartridge and propagate towards the barrier to be breached. In embodiments wherein an eject cartridge is not used, it is envisaged that a mechanical force (for instance pneumatic) or a gas pressure may be applied to directly to propel the breaching device towards a barrier.

The housing in particular embodiments of the invention may be substantially cylindrical and have a maximum diameter of 40 mm. Examples of equipment suitable for launching 40 mm breaching rounds include the AG36 and the Milkor MGL. The housing may further be formed from low fragment hazard materials such as plastics or fibre reinforced plastics (such as nylon or glass reinforcements).

The stand-off breaching device, in some embodiments, may additionally comprise means for self-destruction. The means for self-destruction may allow the stand-off breaching device to be destroyed (for instance by detonation of the explosive main charge) if the breaching device misses the intended target barrier. For instance the electronics module in the proximity sensor may monitor the received radiation of predetermined wavelength and determine signal difference that varies continuously towards the barrier, thereby predicting an impact time. Should the impact time elapse and the breaching device not have been detonated, then the explosive main charge may be detonated regardless.

In embodiments of the invention the explosive main charge has a mass of less than 50 g, or preferably a mass of less than or equal to 20 g. Current stand-off breaching rounds require a relatively large explosive main charge (>45 g) owing to the point of detonation being at the barrier-end of the charge. In such configurations the detonation wave actually travels away from the intended barrier target. In accordance with the invention, detonation at the rear-end of the explosive main charge ensures the detonation wave travels towards the intended target. In particular, for embodiments of the invention comprising the conically formed explosive main charge, a comparable breaching effect to cylindrical explosive main charges, can be achieved at significantly lower mass. This is particularly advantageous from a size and weight perspective for a user carrying one or more breaching devices. Furthermore, reducing the mass of the explosive main charge has benefits with respect to manufacturing safety and cost. Optionally, additional non-explosive ballast material may be used inside the breaching device, where additional weight is required for particular ballistic trajectories.

Some embodiments further comprise an on-board power supply which may be a chemical or thermal battery or other form of stored energy (for instance capacitive storage). The on-board power supply may comprise a single power source or multiple power sources. The on-board power supply may be electrically connected to the detonator, and/or electrically connected to other components of the stand-off breaching device. The on-board power supply may advantageously be a set-back battery. A set-back battery is electrically isolated from other components in the stand-off breaching device until the device is in use. Electrical connection to the set-back battery is only provided upon launch of the stand-off breaching device i.e. the acceleration experienced by the breaching device forces the set-back battery into electrical contact with other components of the stand-off breaching device. A set-back battery configuration therefore provides additional precaution against accidental detonation of the explosive main charge.

Embodiments of the invention may comprise a slapper plate attached at the barrier-end of the explosive main charge. Upon detonation of the explosive main charge the slapper plate is propelled towards the barrier and transfers energy to the barrier over the surface area of the plate. This provides mitigation against concentrated pressure from the use of the breaching device perforating the barrier, rather than deforming the barrier, in order to achieve the desired breaching effect.

According to a second aspect of the invention there is provided a barrier breaching system comprising the stand-off breaching device of the first aspect of the invention and a launcher, the launcher being suitable for firing the stand-off breaching device towards a barrier.

According to a third aspect of the invention there is provided a method of breaching a barrier, comprising the steps of: Providing a stand-off breaching device comprising a housing, an explosive main charge having a barrier-end and a rear-end, a detonator, and means for initiating the detonator when the explosive main charge is at a preselected distance from a barrier, wherein the detonator is configured to detonate the explosive main charge at the rear-end; locating the stand-off breaching device proximal to the barrier, such that the barrier-end is in facing relations with the barrier and is at the preselected distance from the barrier; and then initiating the detonator using the means for initiating, thereby generating an explosively generated overpressure; such that the barrier is breached by the explosively generated overpressure.

Prior art methods of breaching a barrier using explosively generated overpressure use breaching devices comprising explosives detonated at the barrier-end. Energy is wasted in these devices as a result of the detonation wave propagating through the explosive main charge in a direction away from the barrier. The method of the invention achieves a detonation wave propagating through the explosive main charge towards the barrier being breached, therefore less explosive energy is wasted in off-barrier directions. This allows for a reduction in overall charge mass. Locating the stand-off breaching device proximal to the barrier may comprise launching the device towards the barrier.

BRIEF DESCRIPTION OF THE DRAWINGS

Embodiments of the invention will now be described by way of example only and with reference to the accompanying drawings, in which:

FIG. 5*b* shows an illustration of a door barrier being breached with fragmentation;

DETAILED DESCRIPTION

Figure 1:
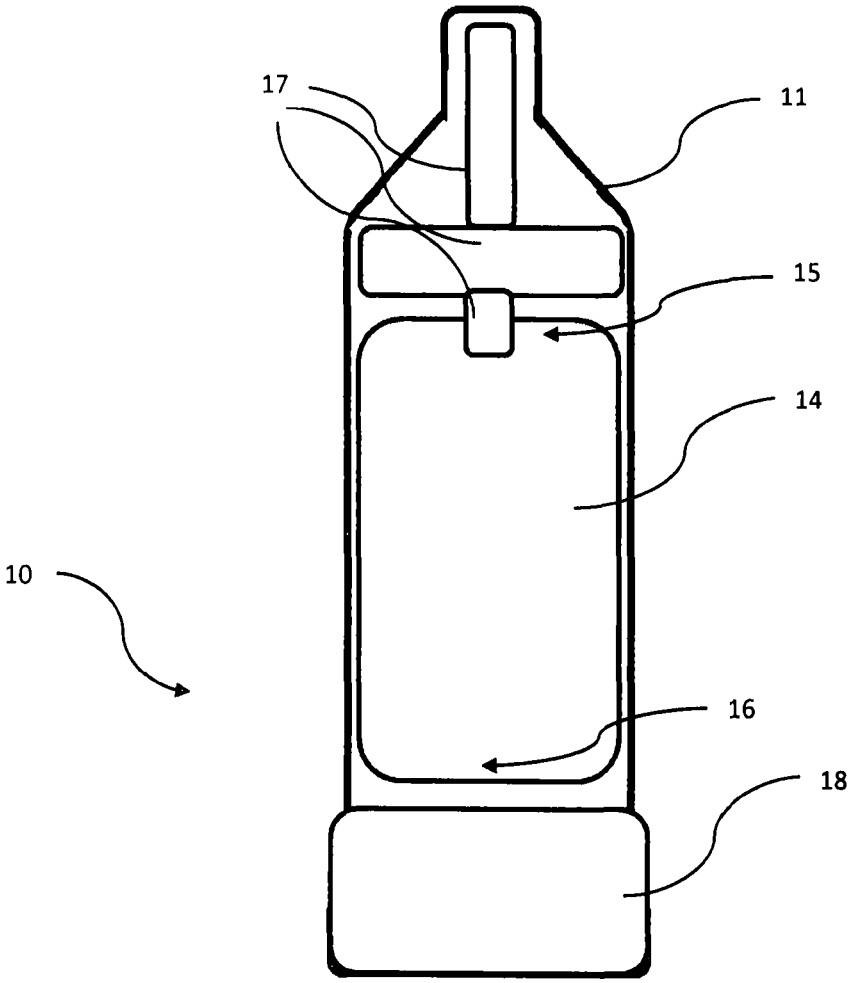
Figure 1 Prior Art
FIG. 1 shows a cross-sectional view of a representation of a prior art stand-off breaching round comprising an impact fuze.

FIG. 1 shows a cross-sectional view of a representation of a prior art stand-off breaching round 10 comprising an impact fuze 17. The breaching round 10 comprises a housing 11 and contained within the housing 11 is an explosive main charge 14 with barrier-end 15 and rear-end 16. Attached to the rear of housing 11 is an eject cartridge 18. When deployed the breaching round 10 must impact a barrier to detonate. Upon impact the impact fuze 17 detonates the explosive main charge 14 at the barrier-end 15. The point of detonation of the explosive main charge 14 is typically in the middle (concentric) of the barrier-end 15 of main charge 14. This is particularly inefficient as the detonation must propagate through the explosive main charge 14 towards the rear-end 16 i.e. away from the barrier being breached and towards the user of the breaching device. Furthermore radial over-pressures (parallel to the face of the barrier-end 15) are generated upon detonation, wasting further blast energy. The explosive main charge 14 will typically therefore have a relatively large mass of between 45 g and 100 g to compensate for these inefficiencies. The stand-off breaching device 10 may impact a barrier slightly off axis (i.e. barrier-end 15 may not be perfectly parallel with the plane of the barrier upon impact). As a result, radial over pressures may cause undesirable fragmentation of the barrier back towards the user, forcing the user to stand-off from the barrier at distances in the region of 10-15 m.

Figure 2:
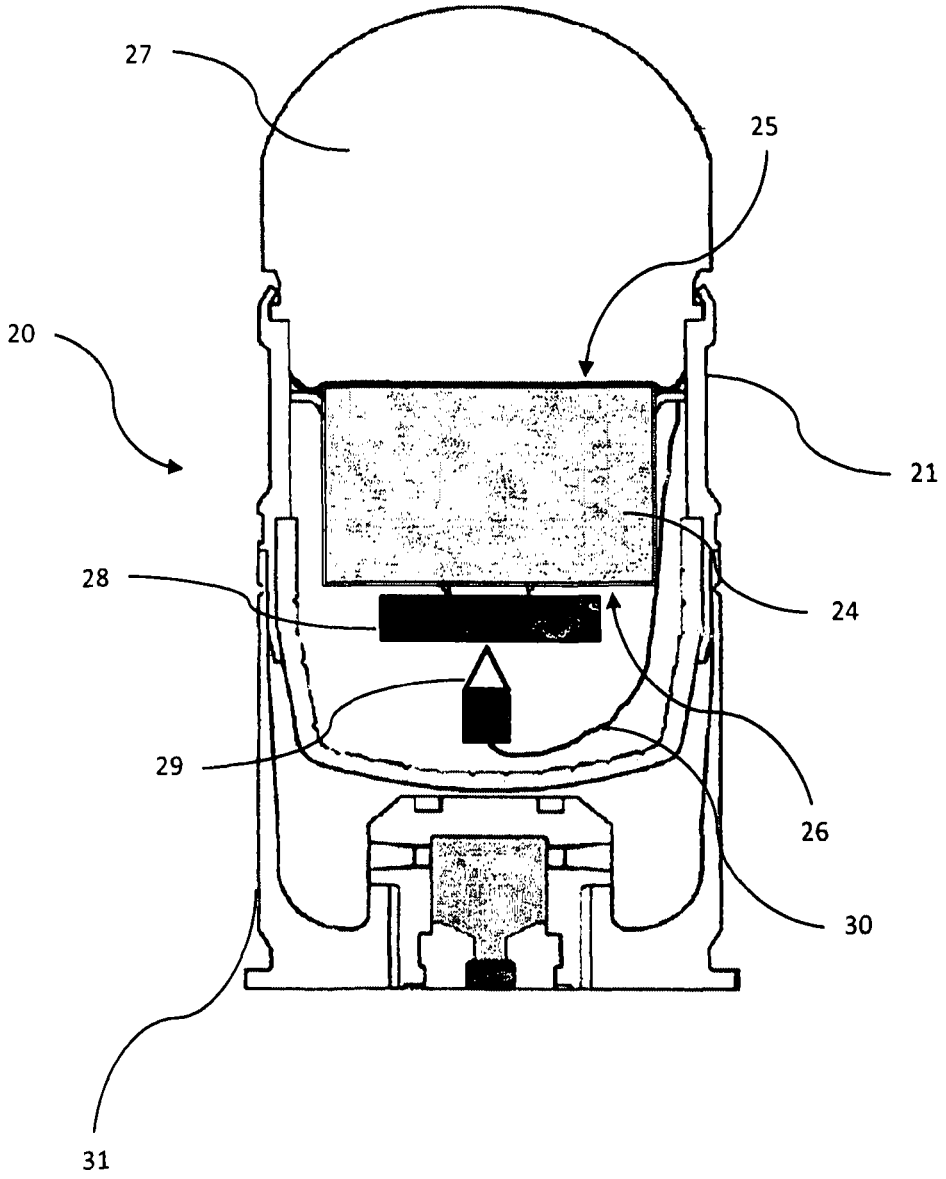
FIG. 2 shows a cross-sectional view of a representation of an embodiment of the invention comprising a cylindrical explosive main charge.

FIG. 2 shows a cross-sectional view of a representation of an embodiment of the stand-off breaching device of the invention 20. The stand-off breaching device 20 comprises a housing 21 containing a cylindrical explosive main charge 24 with a barrier-end 25 and a rear-end 26. The housing 21 also contains means for initiating the detonator in the form of a proximity sensor 27. The cylindrical explosive main charge 24, in contrast with the prior art, is detonated at the rear-end 26 by detonator 29. Also provided as part of the means for initiating the detonator, is the safe-to-arm unit 28. The detonator 29 is shown as being electrically connected by electrical wire 30 to the proximity sensor 27, such that when the proximity sensor 27 determines the stand-off breaching device 20 is in sufficient proximity to the barrier to be breached (less than or equal to a preselected distance), the detonator 29 can be triggered and detonate the explosive main charge 24. An on-board power supply is not visible in the figure. The stand-off breaching device 20 further comprises an eject cartridge 31. Advantageously by detonating the explosive main charge 24 at the rear-end 26, the detonation propagates from the rear-end 26 through the explosive main charge 24 towards the breaching end 25, and towards the barrier being breached. As a result the explosively generated overpressure from explosive main charge 24 is more efficiently delivered to the barrier to achieve the breaching effect.

Figure 3:
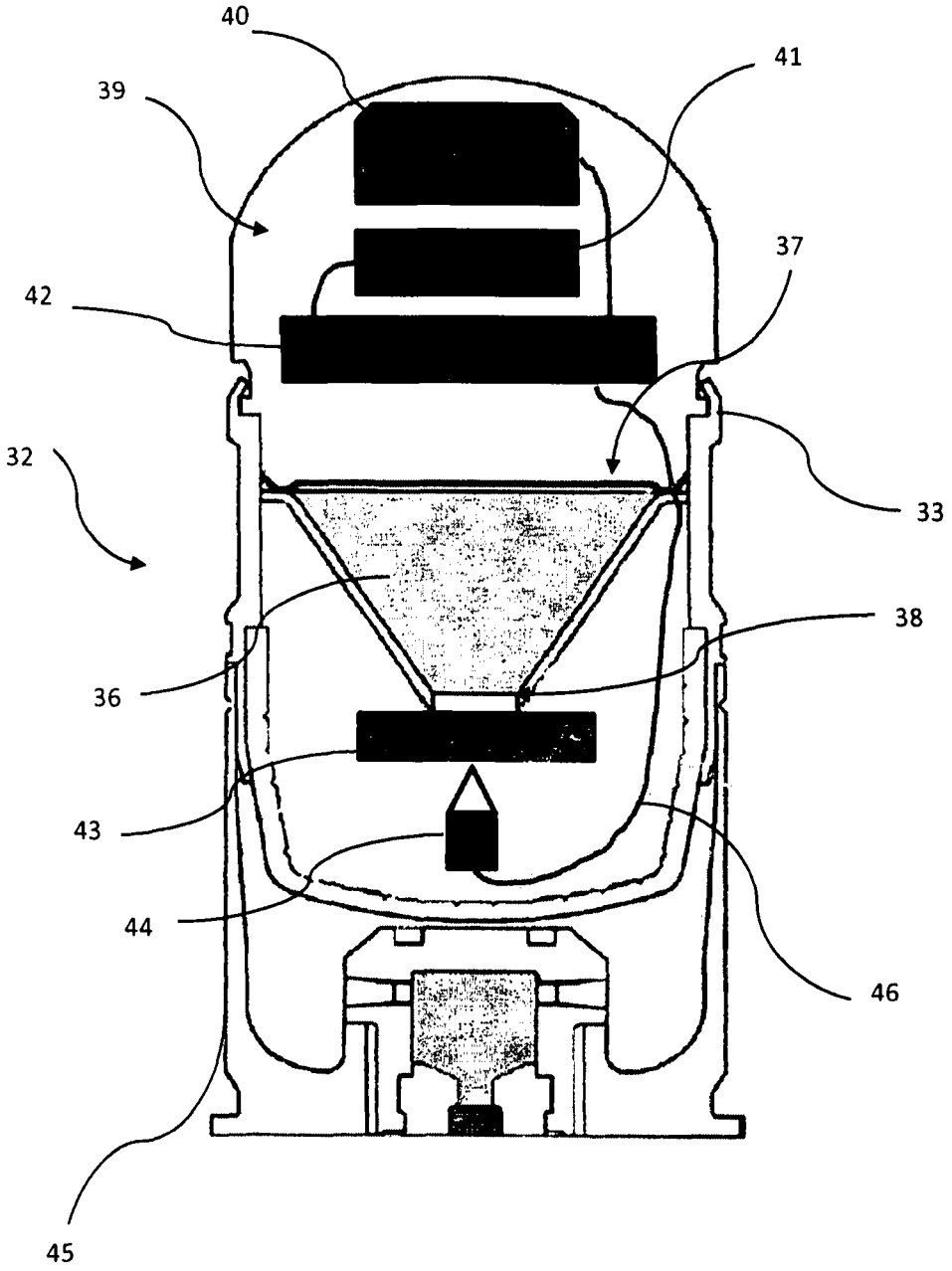
FIG. 3 shows a cross-sectional view of a representation of an embodiment of the invention comprising a conically formed explosive main charge.

FIG. 3 shows a cross-sectional view of a representation of an embodiment of the invention 32 comprising a conically formed explosive main charge 36. The stand-off breaching device 32 comprises a housing 33 manufactured from a non-metallic material such as nylon or glass reinforced plastic, thereby minimising any fragmentation hazard when the breaching device 32 is used. The conically formed explosive main charge 36 has a substantially circular end as the breaching-end 37 and a truncated cone apex as the rear-end 38. The shape of the main charge 36 has been formed by pressing an explosive material into the conical recess formed between rear-end 38 and breaching-end 37. The conically formed explosive main charge 36 in this embodiment has an apex-angle of 60 degrees. The explosive main charge 36 is detonated at the rear-end 38 and therefore the detonation propagates towards the barrier-end 37 and the barrier being breached. Furthermore, the radial overpressures (wasted energy) are reduced owing to the conical design. As a result, the envisaged mass of the main charge 36 is less than 20 g. The proximity sensor 39 of FIG. 3 comprises an ultrasonic transceiver 40 (for instance a Pro-Wave 400EP250 transceiver) and electronics module 42 (for instance a PIC12LF1822). The on-board power supply 41 is electrically connected to electronics module 42, the electronics module 42 then being electrically connected to transceiver 40 and detonator 44. A safe-to-arm unit 43 is provided that comprises a rotor onto which the stab detonator of detonator 44 is positioned. The rotor is purely mechanical in operation and therefore requires no electrical power. In this particular embodiment, when the stand-off breaching device is launched, the device rotates owing to a rifling effect from the launch apparatus. The rotation exerts a force on stab detonator of detonator 44. The force causes the rotor of safe-to-arm unit to rotate into alignment with firing pin of detonator 44, where it is subsequently locked into position. Therefore when a sufficient number of rotations of the stand-off breaching round have elapsed, the breaching device is 'armed' and will detonate when a first detonation signal is generated. During use of breaching device 32, the transceiver 40 constantly transmits towards a barrier to be breached, and receives therefrom, ultrasonic radiation of predetermined wavelength. The electronics module 42 then measures a signal-difference between the transmitted radiation of predetermined wavelength and the received radiation of predetermined wavelength, the signal-difference corresponding to range-to-go. When the range-to-go decreases below a preselected distance, the electronics module 42 generates a first detonation signal and transmits it electrically along electrical wires 46 to the firing pin actuator of detonator 44. The electronics module 42 may calculate the range-to-go based on reading in data from the transceiver 40 when operating in a pulsed transmit/receive mode. For instance, a 4 kHz operating frequency for transceiver 40 would provide 800 samples of data over a 15 m range with ~0.2 second flight time, thereby achieving a range fidelity of 1.8 cm. The detonator 44 is a firing pin and firing pin actuator. The firing pin actuator is connected by electrical wires 46 to the proximity sensor 39. The firing pin actuator is a piston actuator and upon receiving the first detonation signal along electrical wire 46, a propellant charge is initiated in the piston actuator via a bridge wire, thereby driving the piston actuator and the firing pin of detonator 44 towards the now aligned stab detonator of detonator 44. As a result of the detonator receiving the first detonation signal (and the resultant stab detonation), the explosive main charge 36 is detonated at the rear-end 38.

Figure 4:
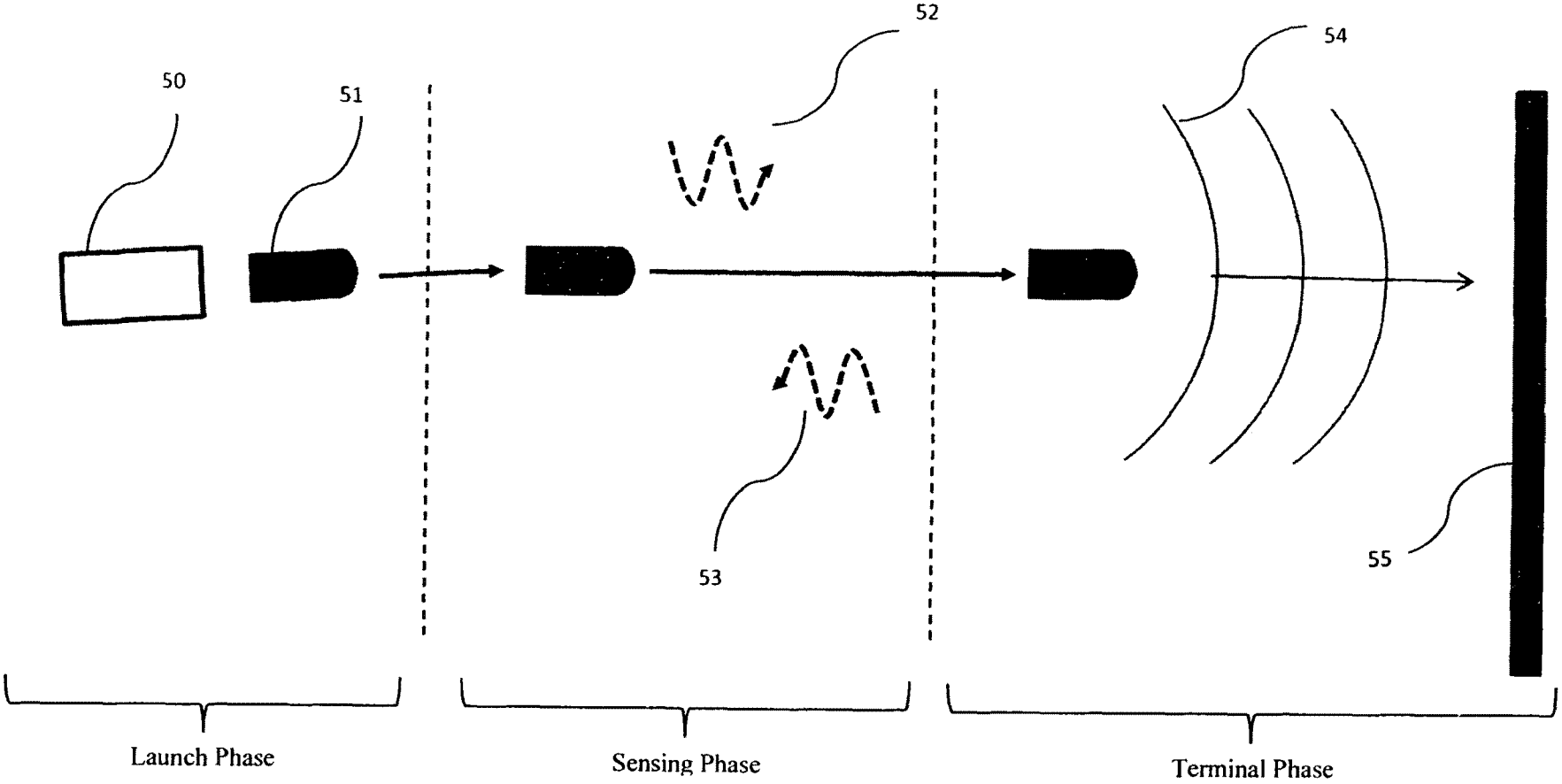
FIG. 4 shows an illustration of an embodiment of the invention being deployed, the embodiment comprising a proximity sensor, the proximity sensor itself comprising a transceiver.

FIG. 4 shows an illustration of an embodiment of the stand-off breaching device 51 being used. The breaching device 51 undergoes three phases of deployment. In the 'launch phase' a user orientates a launcher 50 towards a barrier to be breached 55 at a particular stand-off distance. The breaching device 51 is ejected from the launcher 50 through use of an eject cartridge (not shown). Upon launch a safe-to-arm unit of breaching device 51 detects at least a first post-launch criterion and 'arms' the breaching device 51. The breaching device 51 then enters the 'sensing phase' wherein a proximity sensor (not shown) in breaching device 51 transmits radiation of predetermined wavelength 52 and receives said radiation 53 after it is reflected from barrier 55. An electronics module (not shown) inside the proximity sensor processes the transmitted and received radiation and calculates the range-to-go to the barrier 55. When the range-to-go drops below a particular value (the preselected distance), the breaching device 51 enters the terminal phase of deployment. In the terminal phase the electronics module in the proximity sensor generates a first detonation signal. The first detonation signal is received by the detonator of breaching device 51, thereby resulting in detonation of the explosive main charge of breaching device 51. The point of detonation of the explosive main charge is at the rear-end of the charge, therefore the detonation wave (and explosive shockwave 54) propagates towards barrier 55, achieving the desired breaching effect. In different embodiments of the invention, the proximity sensor of breaching device 51 does not transmit radiation of predetermined wavelength 52. Instead the launcher 50 transmits the radiation of the predetermined wavelength 52, with the proximity sensor of breaching device 51 receiving the reflected radiation of predetermined wavelength 53 only.

Figure 5A:
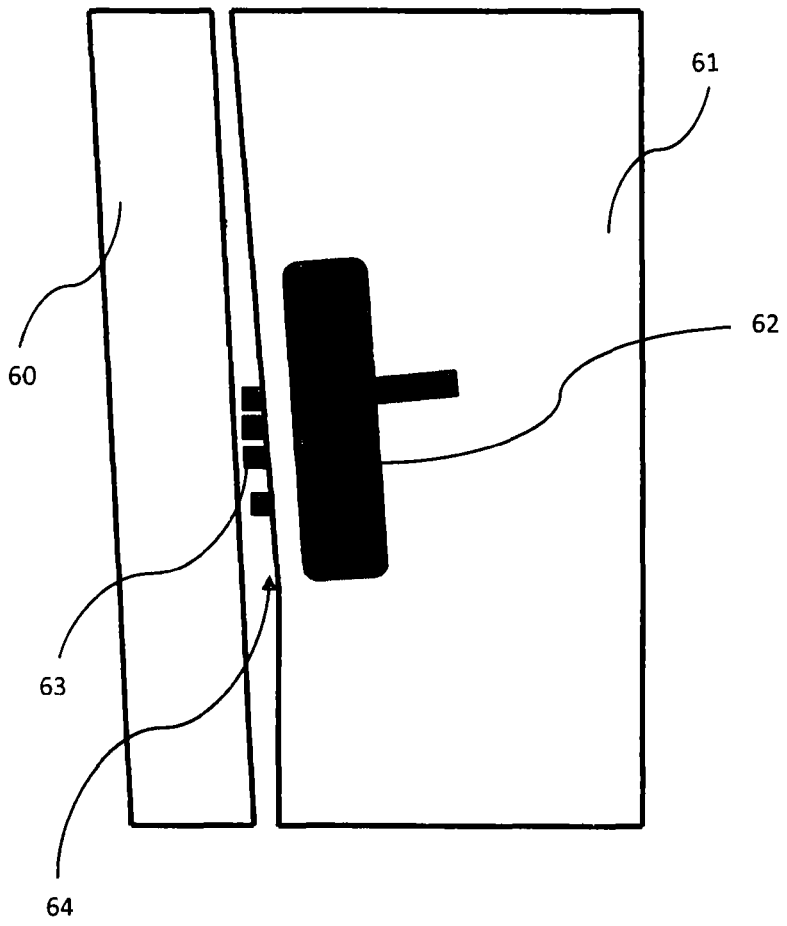
FIG. 5*a* shows an illustration of a door barrier being breached without fragmentation.

FIG. 5*a* shows an illustration of the barrier breaching effect delivered by embodiments of the stand-off breaching device. Part of a door frame 60 and door 61 is shown with handle 62 and locking mechanism 63. The door 61 has been deformed sufficiently along edge 64 so as to disengage locking mechanism 63 from door frame 60. The breaching effect has not resulted in fragmentation of the door 61. In contrast, FIG. 5*b* shows an illustration of the barrier breaching effect of some prior art impact breaching rounds. Door frame 70 and door 71 are shown, with door 71 featuring an aperture 73 that has been blasted through the door 71 as a result of the detonation of an impact fuze based breaching round. Door 71 would have fragmented upon creation of aperture 73, presenting a hazard to persons or equipment. Embodiments of the invention allow for deformation and forcing open of a barrier, whilst minimising fragmentation of the barrier and therefore minimising risk of harm to the user of the invention.

Figure 6A:
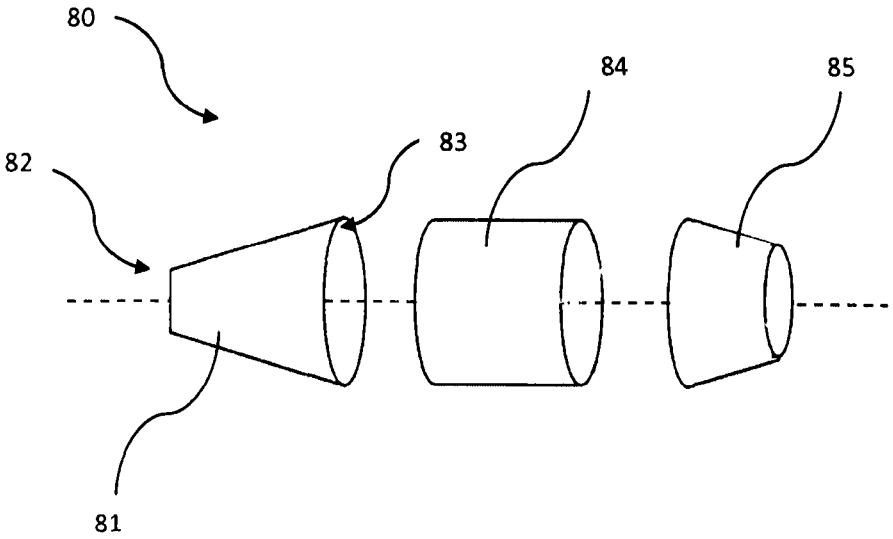
FIG. 6*a* shows an illustration of an embodiment of a conically formed explosive main charge with a charge extension, in expanded view.
Figure 6B:
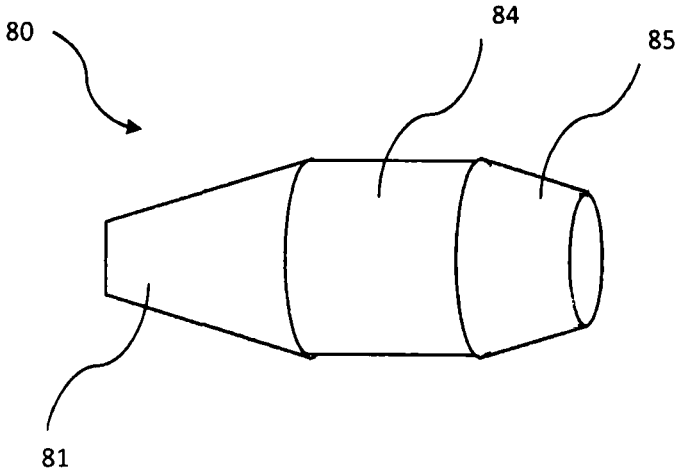
FIG. 6*b* shows an illustration of the conically formed explosive main charge of FIG. 6*a* in perspective view.

FIG. 6*a* provides an illustration of an explosive main charge 80 in expanded view. The explosive main charge 80 comprises a truncated conically formed charge 81 having a rear-end 82 and a barrier-end 83. Extending from the barrier-end 83 is a charge extension comprising a cylindrical part 84 and an inverted truncated cone part 85. FIG. 6*b* shows the explosive main charge 80 in perspective view. The truncated conically formed charge 81, cylindrical part 84 and inverted cone part 85 are shown as distinct parts, but may be a single pressed explosive charge. Cylindrical part 84 may not be present in some embodiments, and the dimensions and cone apex angles shown in the diagram are illustrative only, and not intended to be limiting.

Figure 7:
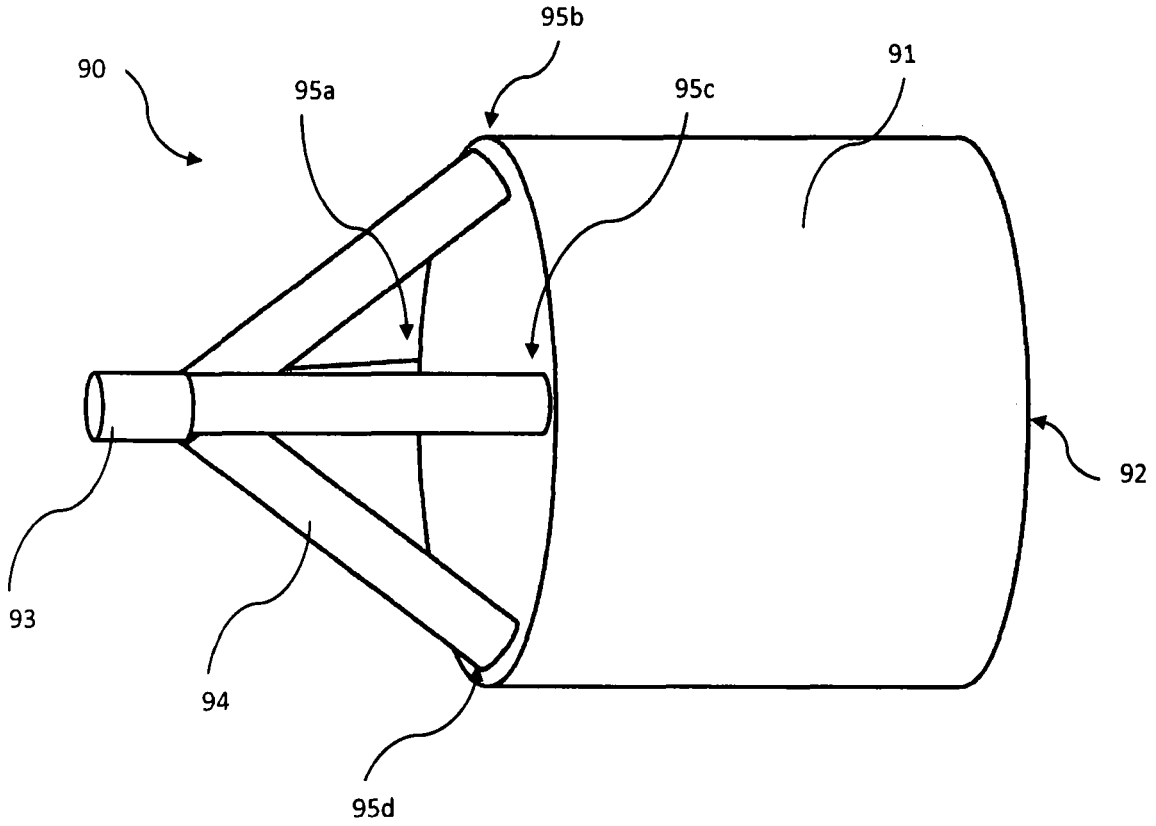
FIG. 7 shows an illustration of an embodiment of a multi-point initiated explosive main charge.

FIG. 7 provides an illustration of a multi-point initiated explosive main charge 90. The explosive main charge 90 comprises a cylindrical part 91 with barrier-end 92 highlighted for clarity. A central point of detonation 93 is provided with stems 94 to transfer the detonation to points 95*a*, 95*b*, 95*c* and 95*d* on cylindrical charge part 91. The detonation of cylindrical charge part 91 occurs substantially simultaneously at the multiple positions 95*a-d*. The central point of detonation 93, stems 94, and cylindrical part 91 comprise explosive material, however each may be encased in suited environmental protection (such as low fragment hazard plastic.

Whilst the embodiments of the invention described comprise proximity sensing, other types of fuzing can be used in the means for initiating the detonator, such as impact fuzes. Impact fuzing can be achieved by providing an extension on the housing that impacts the barrier first, thereby decelerating the stand-off breaching device, said deceleration causing mechanical movement of a pin into a stab detonator, for instance. At the point of detonation the explosive main charge will be at a preselected distance from the barrier as defined by the length of the extension of the housing. The explosive main charge may comprise a number of different explosive compositions, for instance plastic explosive or an aluminised explosive fill may be used.

The invention claimed is:

1. A stand-off breaching device for breaching a barrier, comprising a housing, an explosive main charge having a barrier-end and a rear-end, a detonator, and means for initiating the detonator when the explosive main charge is at a preselected distance from a barrier, wherein the detonator is configured to detonate the explosive main charge at the rear-end, such that in-use a barrier can be breached by an explosively generated overpressure.

2. The stand-off breaching device according to claim 1 wherein the explosive main charge is a conically formed explosive main charge having a substantially circular end and a cone-apex, the conically formed explosive main charge being arranged such that the substantially circular end is the barrier-end and the cone-apex is the rear-end.

3. The stand-off breaching device according to claim 2 wherein the cone-apex is a truncated cone-apex.

4. The stand-off breaching device according to claim 2 wherein the conically formed explosive main charge has an apex-angle in a range of 50 to 70 degrees.

5. The stand-off breaching device according to claim 2 wherein the conically formed explosive main charge further comprises a charge extension formed at the substantially circular end.

6. The stand-off breaching device according to claim 5 wherein the charge extension comprises an inverted truncated cone.

7. The stand-off breaching device according to claim 1 wherein the explosive main charge comprises a multi-point initiated explosive main charge.

8. The stand-off breaching device according to claim 1 wherein the means for initiating the detonator comprises a proximity sensor, the proximity sensor being configured to receive radiation of a predetermined wavelength.

9. The stand-off breaching device according to claim 8 wherein the proximity sensor is configured to transmit radiation of the predetermined wavelength.

10. The stand-off breaching device according to claim 9 wherein the proximity sensor further comprises an electronics module, the electronics module being configured to measure a signal-difference between a transmitted radiation of the predetermined wavelength and a received radiation of the predetermined wavelength, the signal-difference corresponding to a range-to-go.

11. The stand-off breaching device according to claim 10 wherein the electronics module is configured to output a first detonation signal when the range-to-go is less than or equal to the preselected distance.

12. The stand-off breaching device according to claim 11 wherein the preselected distance is between 50 mm and 250 mm.

13. The stand-off breaching device according to claim 11 wherein the means for initiating the detonator further comprises a safe-to-arm unit, the safe-to-arm unit being configured to allow detonation of the explosive main charge upon detecting at least a first post-launch criterion and a generation of the first detonation signal.

14. The stand-off breaching device according to claim 8 wherein the radiation of the predetermined wavelength is acoustic radiation with a wavelength, or range of wavelengths, between 20 kHz and 100 KHz.

15. The stand-off breaching device according to claim 8 wherein the radiation of the predetermined wavelength is electromagnetic radiation with a wavelength, or range of wavelengths, between 800 nm and 1200 nm.

16. The stand-off breaching device according to claim 1 wherein the detonator comprises a firing pin, firing pin actuator and a stab detonator.

17. The stand-off breaching device according to claim 1 further comprising an eject cartridge attached to the housing.

18. The stand-off breaching device according to claim 1 wherein the housing is substantially cylindrical and has a maximum diameter of 40 mm.

19. The stand-off breaching device according to claim 1 wherein the housing is formed from low fragment hazard materials.

20. The stand-off breaching device according to claim 1 further comprising a means for self-destruction.

21. The stand-off breaching device according to claim 1 wherein the explosive main charge has a mass of less than 50 g.

22. The stand-off breaching device according to claim 21 wherein the explosive main charge has a mass less than or equal to 20 g.

23. The stand-off breaching device according to claim 1 further comprising an on-board power supply.

24. The stand-off breaching device of claim 1, wherein the detonator is located adjacent to the rear end of the explosive charge.

25. A barrier breaching system comprising the stand-off breaching device of claim 1 and a launcher, the launcher being suitable for firing the stand-off breaching device towards a barrier.

26. A method of breaching a barrier, the method comprising the steps of:

a) Providing a stand-off breaching device comprising a housing, an explosive main charge having a barrier-end and a rear-end, a detonator, and means for initiating the detonator when the explosive main charge is at a preselected distance from a barrier, wherein the detonator is configured to detonate the explosive main charge at the rear-end;

b) Locating the stand-off breaching device proximal to the barrier, such that the barrier-end is in facing relations with the barrier and is at the preselected distance from the barrier; and then c) Initiating the detonator using the means for initiating, thereby generating an explosively generated overpressure; such that the barrier is breached by the explosively generated overpressure.

27. An explosive main charge for use in stand-off barrier breaching, comprising a conically formed explosive charge having a substantially circular end and a cone-apex, such that in-use the explosive main charge is arrangeable to have the substantially circular end facing a barrier to be breached, such that the main charge is configured to detonate at the cone-apex to generate an overpressure directed towards the barrier, wherein the explosive main charge further comprises a charge extension extending from the substantially circular end, such that in-use the overpressure directed towards the barrier has a predetermined pressure profile.

28. The explosive main charge of claim 27, wherein the charge extension comprises an inverted truncated cone extending from the substantially circular end.

29. The explosive main charge of claim 28, wherein the inverted truncated cone has a maximum diameter equal to a diameter of the substantially circular end.

30. The explosive main charge of claim 29, wherein the cone-apex of the conically formed explosive charge is a truncated cone apex.

31. The explosive main charge of claim 30, wherein the charge extension further comprises a cylindrical part located between the conically formed explosive charge and the inverted truncated cone.

* * * * *